US009953627B2

(12) United States Patent
Christoph et al.

(10) Patent No.: US 9,953,627 B2
(45) Date of Patent: Apr. 24, 2018

(54) ENGINE NOISE CONTROL

(71) Applicant: HARMAN BECKER AUTOMOTIVE SYSTEMS GMBH, Karlsbad (DE)

(72) Inventors: Markus Christoph, Straubing (DE); Nikos Zafeiropoulos, Straubing (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 0 days.

(21) Appl. No.: 15/294,278

(22) Filed: Oct. 14, 2016

(65) Prior Publication Data

US 2017/0110108 A1 Apr. 20, 2017

(30) Foreign Application Priority Data

Oct. 16, 2015 (EP) ..... 15190171

(51) Int. Cl.
*G10K 11/178* (2006.01)

(52) U.S. Cl.
CPC .... *G10K 11/1788* (2013.01); *G10K 2210/129* (2013.01); *G10K 2210/12822* (2013.01); *G10K 2210/3022* (2013.01); *G10K 2210/3028* (2013.01)

(58) Field of Classification Search
CPC ..... G10K 11/178; G10K 2210/3022; G10K 2210/3028
USPC ..... 381/71.2, 71.11, 71.12, 71.8, 71.9
See application file for complete search history.

(56) References Cited

U.S. PATENT DOCUMENTS 5,325,437 A 6/1994 Doi et al.
5,332,061 A * 7/1994 Majeed ..... B60K 5/1283 180/312
5,967,269 A * 10/1999 Kato ..... F16F 15/03 188/380
2004/0240677 A1* 12/2004 Onishi ..... G10K 11/1784 381/71.4
2010/0014685 A1* 1/2010 Wurm ..... G10K 11/178 381/71.11

FOREIGN PATENT DOCUMENTS

EP 2251860 A1 11/2010

OTHER PUBLICATIONS

European Search Report for Application No. 15190171.7, dated Apr. 25, 2016, 9 pages.

* cited by examiner

*Primary Examiner* — Melur Ramakrishnaiah
(74) *Attorney, Agent, or Firm* — Brooks Kushman P.C.

(57) ABSTRACT

An exemplary engine noise control includes directly picking up engine noise from an engine of a vehicle at a pick-up position to generate a sense signal representative of the engine noise, and active noise control filtering to generate a filtered sense signal from the sense signal. The control further includes converting the filtered sense signal from the active noise control filtering into anti-noise and radiating the anti-noise to a listening position in an interior of the vehicle. The filtered sense signal is configured so that the anti-noise reduces the engine noise at the listening position.

21 Claims, 3 Drawing Sheets

ENGINE NOISE CONTROL

CROSS-REFERENCE TO RELATED APPLICATIONS

This application claims priority to EP application Serial No. 15190171.7 filed Oct. 16, 2015, the disclosure of which is hereby incorporated in its entirety by reference herein.

TECHNICAL FIELD

The disclosure relates to engine noise control systems and methods.

BACKGROUND

Engine order cancellation (EOC) technology uses a non-acoustic signal representative of the engine (motor) noise as a reference to synthesize a sound wave that is opposite in phase to the engine noise audible in the car interior. As a result, EOC makes it easier to reduce the use of conventional damping materials. Common EOC systems utilize a narrow-band feed-forward active noise control (ANC) framework in order to generate anti-noise by adaptive filtering of a reference signal that represents the engine harmonics to be cancelled. After being transmitted via a secondary path from an anti-noise source to a listening position, the anti-noise has the same amplitude but opposite phase as the signals generated by the engine filtered by a primary path that extends from the engine to the listening position. Thus, at the place where an error microphone resides in the room, for example, at or close to the listening position, the overlaid acoustical result would ideally become zero so that error signals picked up by the error microphone would only record sounds other than the cancelled harmonic noise signals generated by the engine.

Commonly a non-acoustical sensor, for example, a sensor measuring the repetitions-per-minute (RPM), is used as a reference. The signal from the RPM sensor can be used as a synchronization signal for synthesizing an arbitrary number of harmonics corresponding to the engine harmonics. The synthesized harmonics form a basis for noise canceling signals generated by a subsequent narrowband feed-forward ANC system. Even if the engine harmonics mark the main contributions to the total engine noise, they by no means cover all noise components radiated by the engine, such as bearing play, chain slack, or valve bounce. However, an RPM sensor is not able to cover signals other than the harmonics.

SUMMARY

An example engine noise control system includes a noise and vibration sensor configured to directly pick up engine noise from an engine of a vehicle and to generate a sense signal representative of the engine noise, and an active noise control filter configured to generate a filtered sense signal from the sense signal. The system further includes a loudspeaker configured to convert the filtered sense signal from the active noise control filter into anti-noise and to radiate the anti-noise to a listening position in an interior of the vehicle. The filtered sense signal is configured so that the anti-noise reduces the engine noise at the listening position.

An example engine noise control method includes directly picking up with a noise and vibration sensor engine noise from an engine of a vehicle at a pick-up position to generate a sense signal representative of the engine noise, and active noise control filtering to generate a filtered sense signal from the sense signal. The method further includes converting the filtered sense signal from the active noise control filtering into anti-noise and radiating the anti-noise to a listening position in an interior of the vehicle. The filtered sense signal is configured so that the anti-noise reduces the engine noise at the listening position.

BRIEF DESCRIPTION OF THE DRAWINGS

The disclosure may be better understood by reading the following description of non-limiting embodiments in connection with the attached drawings, in which like elements are referred to with like reference numbers, wherein below.

DETAILED DESCRIPTION

As the name suggests, EOC technology is only able to control noise that corresponds to engine orders. Other components of the engine noise that have a non-negligible acoustical impact and that cannot be controlled with the signal provided by a narrowband non-acoustic sensor (e.g., RPM sensor) cannot be counteracted with such a system. Noise is generally the term used to designate sound, vibrations, accelerations and forces that do not contribute to the informational content of a receiver, but rather are perceived to interfere with the audio quality of a desired signal. The evolution process of noise can be typically divided into three phases. These are the generation of the noise, its propagation (emission) and its perception. It can be seen that an attempt to successfully reduce noise is initially aimed at the source of the noise itself, for example, by attenuation and subsequently by suppression of the propagation of the noise signal. Nonetheless, the emission of noise signals cannot be reduced to the desired degree in many cases. In such cases the concept of removing undesirable sound by superimposing a compensation signal is applied.

Methods and systems for canceling or reducing emitted noise suppress unwanted noise by generating cancellation sound waves to superimpose on the unwanted signal, whose amplitude and frequency values are for the most part identical to those of the noise signal, but whose phase is shifted by 180 degrees in relation to the unwanted signal. In ideal situations, this method fully extinguishes the unwanted noise. This effect of targeted reduction in the sound level of a noise signal is often referred to as destructive interference or noise control. In vehicles, the unwanted noise can be caused by effects of the engine, the tires, suspension and other units of the vehicle, and therefore varies with the speed, road conditions and operating states in the automobile.

Figure 1:
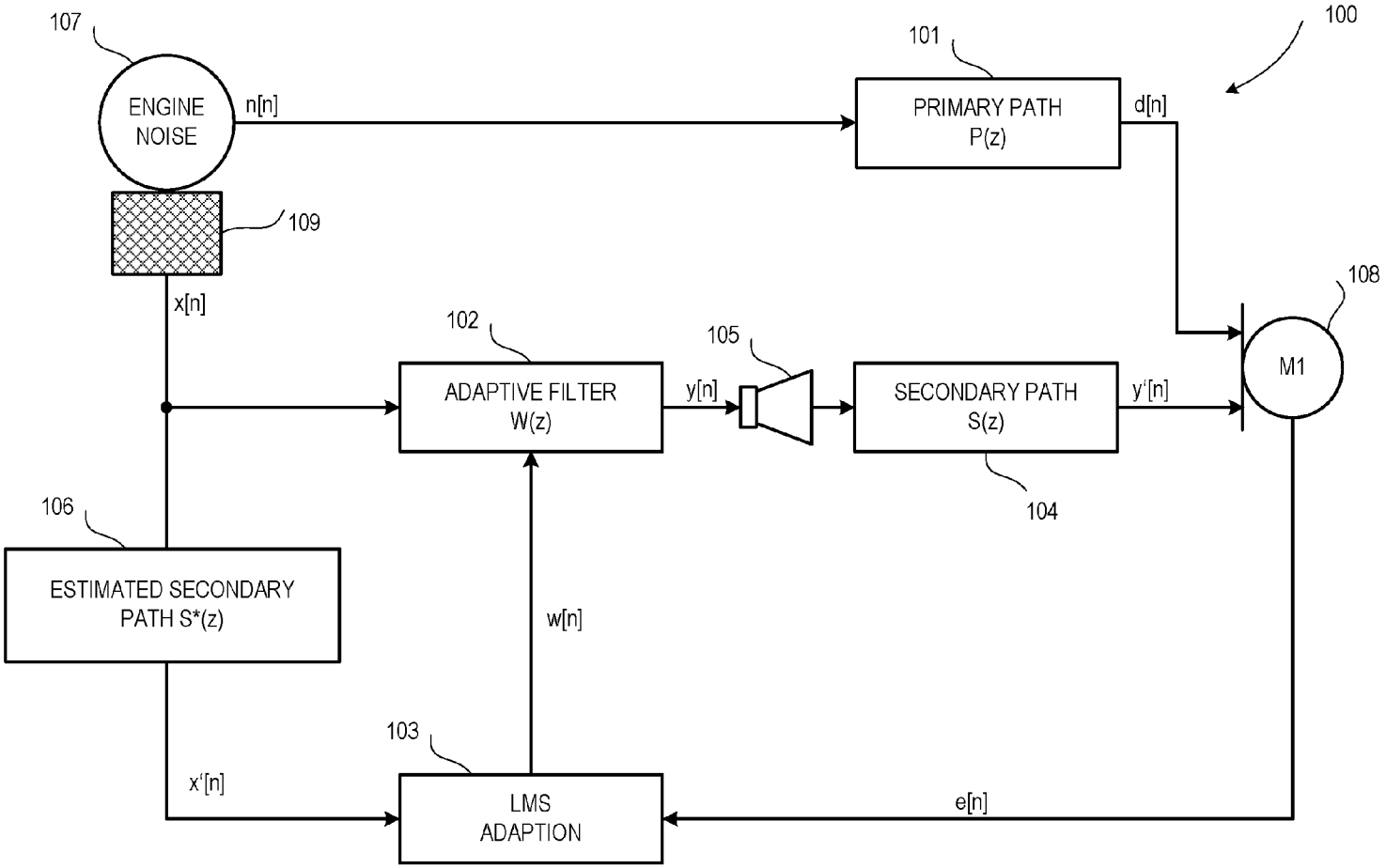
FIG. 1 is a block diagram illustrating an exemplary engine noise control system using a filtered-x least mean square algorithm.

FIG. 1 illustrates an engine noise control (ENC) system 100 in a single-channel configuration to simplify the following description; however, it is not limited thereto. Components such as, for example, amplifiers, analog-to-digital converters and digital-to-analog converters, which are included in an actual realization of the ENC system, are not illustrated herein to further simplify the following description. All signals are denoted as digital signals with the time index n placed in squared brackets.

The ENC system 100 uses the filtered-x least mean square (FXLMS) algorithm and includes a primary path 101 which has a (discrete time) transfer function P(z). The transfer function P(z) represents the transfer characteristic of the signal path between a vehicle's engine whose noise is to be controlled and a listening position, for example, a position in the interior of the vehicle where the noise is to be suppressed. The ENC system 100 also includes an adaptive filter 102 with a filter transfer function W(z), and an LMS adaptation unit 103 for calculating a set of filter coefficients w[n] that determines the filter transfer function W(z) of the adaptive filter 102. A secondary path 104 which has a transfer function S(z) is arranged downstream of the adaptive filter 102 and represents the signal path between a loudspeaker 105 that broadcasts a compensation signal y[n] to the listening position. For the sake of simplicity, the secondary path 104 may include the transfer characteristics of all components downstream of the adaptive filter 102, for example, amplifiers, digital-to-analog-converters, loudspeakers, acoustic transmission paths, microphones, and analog-to-digital-converters. A secondary path estimation filter 106 has a transfer function that is an estimation S*(z) of the secondary path transfer function S(z). The primary path 101 and the secondary path 104 are "real" systems essentially representing the physical properties of the listening room (e.g., the vehicle cabin), wherein the other transfer functions may be implemented in a digital signal processor.

Noise n[n] generated by the engine 107, which includes sound waves, accelerations, forces, vibrations, harness etc., is transferred via the primary path 101 to the listening position where it appears, after being filtered with the transfer function P(z), as disturbing noise signal d[n] which represents the engine noise audible at the listening position within the vehicle cabin. The noise n[n], after being picked up by a noise and vibration sensor such as an force transducer sensor (not shown) or an acceleration sensor 109, serves as a reference signal x[n]. Acceleration sensors may include accelerometers, force gauges, load cells, etc. For example, an accelerometer is a device that measures proper acceleration. Proper acceleration is not the same as coordinate acceleration, which is the rate of change of velocity. Single- and multi-axis models of accelerometers are available for detecting magnitude and direction of the proper acceleration, and can be used to sense orientation, coordinate acceleration, motion, vibration, and shock. The reference signal x[n] provided by the acceleration sensor 109 is input into the adaptive filter 102 which filters it with transfer function W(z) and outputs the compensation signal y[n]. The compensation signal y[n] is transferred via the secondary path 104 to the listening position where it appears, after being filtered with the transfer function S(z), as anti-noise y'[n]. The anti-noise y'[n] and the disturbing noise d[n] are destructively superposed at the listening position. A microphone 108 outputs a measurable residual signal, i.e., an error signal e[n] that is used for the adaptation in the LMS adaptation unit 103. The error signal e[n] represents the sound including (residual) noise present at the listening position, for example, in the cabin of the vehicle.

The filter coefficients w[n] are updated based on the reference signal x[n] filtered with the estimation S*(z) of the secondary path transfer function S(z) which represents the signal distortion in the secondary path 104. The secondary path estimation filter 106 is supplied with the reference signal x[n] and provides a filtered reference signal x'[n] to the LMS adaptation unit 103. The overall transfer function W(z)·S(z) provided by the series connection of the adaptive filter 102 and the secondary path 104 converges against the primary path transfer function P(z). The adaptive filter 102 shifts the phase of the reference signal x[n] by 180 degrees so that the disturbing noise d[n] and the anti-noise y'[n] are destructively superposed, thereby suppressing the disturbing noise d[n] at the listening position.

The error signal e[n] as measured by microphone 108 and the filtered reference signal x'[n] provided by the secondary path estimation filter 106 are supplied to the LMS adaptation unit 103. The LMS adaptation unit 103 calculates the filter coefficients w[n] for the adaptive filter 102 from the filtered reference signal x'[n] ("filtered x") and the error signal e[n] such that the norm (i.e., the power or L2-Norm) of the error signal e[n] is reduced. The filter coefficients w[n] are calculated, for example, using the LMS algorithm. The adaptive filter 102, LMS adaptation unit 103 and secondary path estimation filter 106 may be implemented in a digital signal processor. Of course, alternatives or modifications of the "filtered-x LMS" algorithm, such as, for example, the "filtered-e LMS" algorithm, are also applicable.

Since the acceleration sensor 109 is able to directly pick up noise n[n] in a broad frequency band of the audible spectrum, the system shown in FIG. 1 can be used in connection with broadband filters, wherein the broadband filter providing the transfer function W(z) may alternatively have a fixed transfer function instead of an adaptive transfer function, as the case may be. Directly picking up essentially includes picking up the signal in question with no significant influence by other signals. The system structure may be a feedback structure instead of a feedforward structure as shown. In the engine noise control system shown in FIG. 1, the broadband sensor in connection with a subsequent broadband signal processing allows for picking up the complete engine noise spectrum, in contrast to common EOC systems which use narrowband feed-forward ANC. Since not only the narrowband harmonic components of the engine noise are processed but rather broadband engine noise as well, it appears to be appropriate to differ between an engine order control (EOC) and engine noise control (ENC).

The exemplary system shown in FIG. 1 employs a straightforward single-channel feedforward filtered-x LMS control structure, but other control structures, for example, multi-channel structures with a multiplicity of additional channels, a multiplicity of additional microphones, and a multiplicity of additional loudspeakers, may be applied as well. For example, in total L loudspeakers and M microphones may be employed. Then, the number of microphone input channels into the LMS adaptation unit 103 is M, the number of output channels from adaptive filter(s) 102 is L and the number of channels between estimation filter 106 and LMS adaptation unit 103 is L·M. In the following description, exemplary locations for placing acceleration sensors are outlined.

Figure 2:
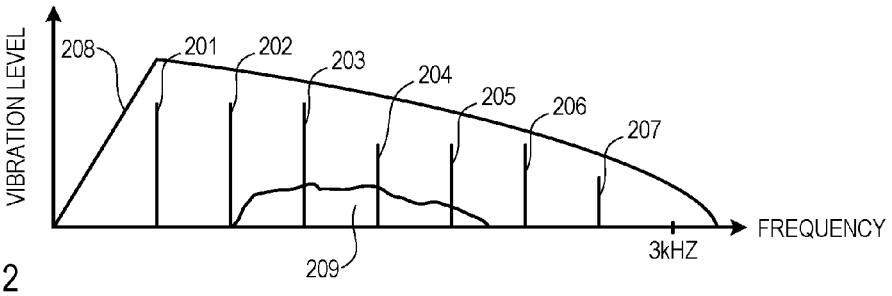
FIG. 2 is a vibration level vs frequency diagram illustrating the spectral characteristic of an exemplary acceleration sensor.

A broadband acceleration sensor is able to pick up engine noise up to at least 1.5 kHz, for example, at least 2 kHz as shown in FIG. 2. FIG. 2 depicts the vibration level vs. frequency for seven engine harmonics 201-207 in which harmonic 201 represents the fundamental frequency as detected by a RPM sensor, and for the sensor frequency characteristic 208 which covers at least the seven engine harmonics 201-207, the highest of which, harmonic 208, may be, for example, around 2.8 kHz. In contrast to an RPM sensor, the acceleration sensor is also able to pick up noise 209 other than the harmonics. Naturally, each acceleration sensor has sufficient dynamic range to capture all harmonics which are audible in the cabin, and has low distortion characteristics so that it outputs linear vibration signals.

One or more noise and vibration sensors, for example, acceleration sensors, used in connection with single-channel or multi-channel ENC systems, may be mounted on flat surfaces on specific locations in the vehicle such as the noise and vibration paths between the engine and the gear box, between the engine and structural elements of the chassis/body of the vehicle, between the engine and the exhaust, at the suspension of the exhaust, on the engine casing, at a firewall between engine and vehicle cabin etc. The one or more acceleration sensors may be disposed, for example, on the engine mounts, at the engine mounting casing or mounting brackets, beyond the engine mounts on the vehicle body structure, on the exhaust mounts and the rear body panel.

Figure 3:
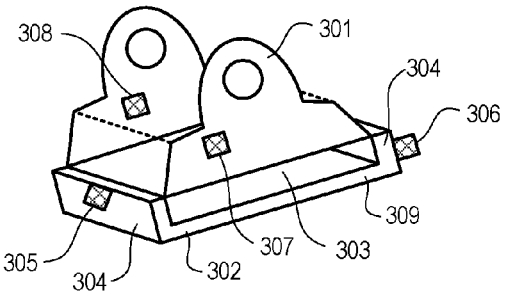
FIG. 3 is a schematic diagram of acceleration sensors attached to an exemplary mounting bracket and a mounting casing.

Referring to FIG. 3, an engine mount plays an important role in reducing the noise, vibrations and harshness to improve vehicle ride comfort. The first and the foremost function of an engine mounting bracket is to properly balance (mount) the power pack (engine and transmission) on the vehicle chassis for good motion control as well as good noise, vibration and harshness isolation. Some engine mounts are made of a steel frame, one side of which is bolted to the cast iron engine block and the other side of which is clamped to the frame by means of a thru-bolt. The upper and lower mount halves are sandwiched within a layer of rubber and cotton fiber reinforcement that is vulcanized and molded to the metal frames. Another type of motor mount may be bolted to the cross-member and attached to the engine by a thru bolt to a metal bracket that is bolted on the block, or the motor mount may be attached directly to the block and be mounted on the chassis by a thru bolt to a stand or bracket that is bolted to the cross-member. In the example shown in FIG. 3, a mounting bracket 301 made of a u-shaped steel frame and a mounting casing 302 are disposed on either side of a rubber block 301, wherein the mounting casing 302 secures the rubber block 303 in at least two directions by way of at least two opposing side walls 304 and a base plate 309. The mounting bracket 301 can be clamped to the frame by way of a thru-bolt and the mounting casing 302 can be bolted to the engine block. Acceleration sensors 305 and 306 may be attached to the side walls 304 and/or acceleration sensors 307 and 308 may be attached to legs of the u-shaped mounting bracket 301.

Figure 4:
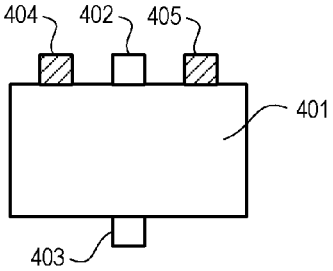
FIG. 4 is a schematic diagram of acceleration sensors attached to an exemplary engine mount.

FIG. 4 depicts an engine mount 401 for securing an engine to a structural element (both not shown) of a vehicle. Engine mounts are used to connect a vehicle engine to a frame of the vehicle chassis/body. They are usually made of rubber and metal. The metal portion connects to the engine on one side and to the frame on the other. The rubber portion is in-between to provide some flexibility so that engine vibrations do not cause the vehicle to shake. In the example shown in FIG. 4, a metal rubber compound 401 can be secured with at least one bolt 402 to the frame (not shown) and with at least one bolt 403 to the engine (not shown). Acceleration sensors 404 and 405 may be attached to a flat surface of the metal rubber compound forming engine mount 401, thereby facing the frame.

Figure 5:
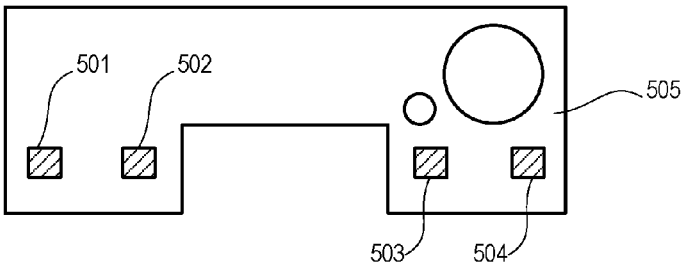
FIG. 5 is a schematic diagram of acceleration sensors attached to an exemplary firewall of a vehicle.

FIG. 5 depicts four acceleration sensors 501-504 mounted on a firewall for measuring the vibrations that cause engine noise radiation. In automotive engineering, a firewall is the part of the bodywork that separates the engine from the driver and passengers. It is most commonly a separate component of the body, or in monocoque constructions, a separate steel pressing, but it may also be continuous with the floor pan or its edges may form part of the door pillars. The firewall may have one or more vibrating panels 505 and the acceleration sensors 501-504 may be placed on at least one of the vibrating panels 505 of the firewall at locations that are above the foot wells of the front passengers and behind the vehicle's cockpit. The acceleration sensors 501-504 may be mounted at the lower firewall panel and may be placed at the side of the panel 505 that faces the cabin or the engine.

Figure 6:
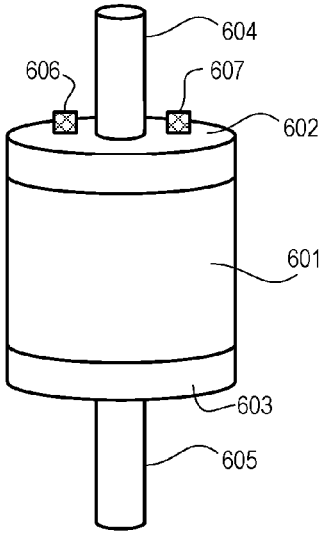
FIG. 6 is a schematic diagram of acceleration sensors attached to an exemplary exhaust suspension.

FIG. 6 depicts an exhaust mount with a rubber bumper 601 and with two metal plates 602 and 603 molded to the rubber bumper 601 at two opposing ends. Two threaded rods 604 and 605 are secured to the metal plates 602 and 603. The threaded rods 604 and 605 can be secured to the vehicle body and the exhaust. Acceleration sensors 606 and 607 are attached to either or both metal plates 602 and 603.

Figure 7:
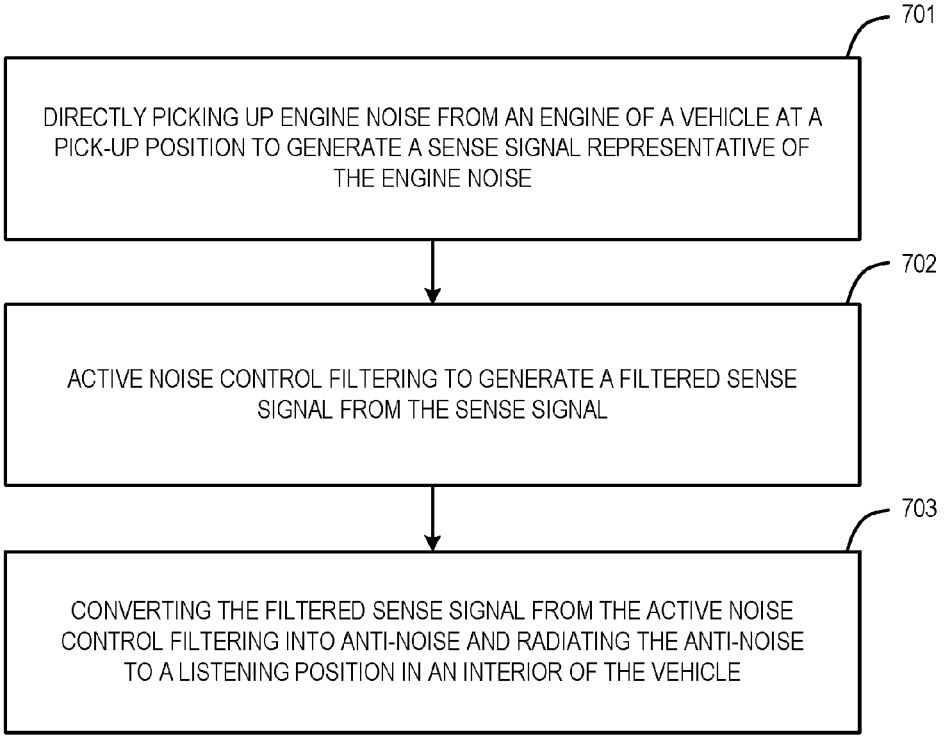
FIG. 7 is a flow chart illustrating an exemplary engine noise control method.

Referring to FIG. 7, an exemplary engine noise control method includes directly picking up engine noise from an engine of a vehicle at a pick-up position to generate a sense signal representative of the engine noise including sound waves, accelerations, forces, vibrations, harness etc. (procedure 701), active noise control filtering to generate a filtered sense signal from the sense signal (procedure 702), and converting the filtered sense signal from the active noise control filtering into anti-noise and radiating the anti-noise to a listening position in an interior of the vehicle (procedure 703). The filtered sense signal is configured so that the anti-noise reduces the engine noise at the listening position.

The description of embodiments has been presented for purposes of illustration and description. Suitable modifications and variations to the embodiments may be performed in light of the above description or may be acquired by practicing the methods. For example, unless otherwise noted, one or more of the described methods may be performed by a suitable device and/or combination of devices. The described methods and associated actions may also be performed in various orders in addition to the order described in this application, in parallel, and/or simultaneously. The described systems are exemplary in nature, and may include additional elements and/or omit elements.

As used in this application, an element or step recited in the singular and preceded by the word "a" or "an" should be understood as not excluding the plural of said elements or steps, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. are used merely as labels, and are not intended to impose numerical requirements or a particular positional order on their objects.

What is claimed is:

1. An engine noise control system comprising:

a noise and vibration sensor configured to directly pick up engine noise from an engine of a vehicle and to generate a sense signal representative of the engine noise;

an active noise control filter configured to generate a filtered sense signal from the sense signal; and a loudspeaker configured to convert the filtered sense signal from the active noise control filter into anti-noise and to radiate the anti-noise to a listening position in an interior of the vehicle; wherein:

the filtered sense signal is configured so that the anti-noise reduces the engine noise at the listening position, and the noise and vibration sensor is a broadband sensor to pick up engine noise from the engine of the vehicle for a complete engine noise spectrum.

2. The system of claim 1, wherein the active noise control filter comprises:

a controllable filter connected downstream of the noise and vibration sensor and upstream of the loudspeaker; and a filter controller configured to receive the sense signal and to control the controllable filter according to the sense signal.

3. The system of claim 2, further comprising a microphone disposed in the interior of the vehicle at or adjacent to the listening position, wherein the microphone is configured to provide an error signal representative of a sound at the listening position and the filter controller is configured to further control the controllable filter according to the error signal.

4. The system of claim 1, wherein:

the engine is fastened to a structural element of the vehicle via an engine mount;

the noise and vibration sensor is fastened to the engine mount or to the structural element in a position adjacent to the engine mount; and the engine mount is constructed of rubber and metal.

5. The system of claim 4, wherein:

the engine mount comprises at least one of an engine mounting casing and an engine mounting bracket; and the noise and vibration sensor is fastened to the engine mounting casing or the engine mounting bracket.

6. The system of claim 1, wherein:

the engine is disposed close to a firewall structure of the vehicle, the firewall structure comprising a vibratory panel; and the noise and vibration sensor is fastened to the vibratory panel.

7. The system of claim 6, wherein an acceleration sensor is disposed on the vibratory panel in a position that is at least one of:

located in a lower part of the vibratory panel; and located on a side of the vibratory panel that faces to or away from the engine.

8. The system of claim 1, wherein the engine is fastened to an exhaust of the vehicle via an exhaust mount; and the noise and vibration sensor is fastened to the exhaust mount.

9. The system of claim 1, wherein the noise and vibration sensor comprises an operating frequency range in excess of 100 Hz and up to at least 2 kHz.

10. The system of claim 1, further comprising at least one additional noise and vibration sensor disposed at a different position than the noise and vibration sensor, the at least one additional noise and vibration sensor being configured to provide at least one additional sense signal to the active noise control filter.

11. An engine noise control method comprising:

directly picking up, with a noise and vibration sensor, engine noise from an engine of a vehicle at a pick-up position to generate a sense signal representative of the engine noise;

active noise control filtering to generate a filtered sense signal from the sense signal; and converting the filtered sense signal from the active noise control filtering into anti-noise and radiating the anti-noise to a listening position in an interior of the vehicle; wherein the filtered sense signal is configured so that the anti-noise reduces the engine noise at the listening position, and the noise and vibration sensor is a broadband sensor to pick up engine noise from the engine of the vehicle for a complete engine noise spectrum.

12. The method of claim 11, wherein the active noise control filtering comprises controlled filtering of the sense signal to provide the filtered sense signal to be converted into anti-noise, wherein the filtering is controlled according to the sense signal.

13. The method of claim 12, further comprising picking up sound in the interior of the vehicle close or adjacent to the listening position to provide an error signal representative of the sound at the listening position, wherein the filtering is further controlled according to the error signal.

14. The method of claim 11, further comprising picking up engine noise from the engine at least at one additional pick-up position other than the pick-up position to provide at least one additional sense signal for active noise control filtering.

15. The method of claim 14, wherein the pick-up position and/or the at least one additional pick-up position are located in at least one of:

at or close to an engine mount;

at or close to a structural element in a position adjacent to the engine mount;

at or close to a vibratory panel of a firewall;

at or close to an exhaust mount; and at or close to the structural element in a position adjacent to an exhaust mount.

16. An engine noise control system comprising:

a noise and vibration sensor configured to pick up engine noise from an engine of a vehicle and to generate a sense signal indicative of the engine noise;

an active noise control filter configured to generate a filtered sense signal from the sense signal; and a loudspeaker configured to convert the filtered sense signal into anti-noise and to radiate the anti-noise to a listening position in an interior of the vehicle to reduce the engine noise at the listening position, wherein the noise and vibration sensor is a broadband sensor to pick up engine noise from the engine of the vehicle for a complete engine noise spectrum.

17. The system of claim 16, wherein the active noise control filter includes a controllable filter connected downstream of the noise and vibration sensor and upstream of the loudspeaker.

18. The system of claim 17, wherein the active noise control filter further includes a filter controller configured to receive the sense signal and to control the controllable filter based on the sense signal.

19. The system of claim 18, further comprising a microphone disposed in the interior of the vehicle at or adjacent to the listening position, wherein the microphone is configured to provide an error signal representative of sound at the listening position and the filter controller is configured to further control the controllable filter based on the error signal.

20. The system of claim 16, further comprising at least one additional noise and vibration sensor being disposed at a different position than the noise and vibration sensor, the at least one additional noise and vibration sensor being configured to provide at least one additional sense signal to the active noise control filter.

21. The system of claim 16, wherein the noise and vibration sensor comprises an operating frequency range in excess of 100 Hz and up to at least 2.8 kHz.

* * * * *